US009325046B2

(12) United States Patent
Hendry et al.

(10) Patent No.: US 9,325,046 B2
(45) Date of Patent: Apr. 26, 2016

(54) MULTI-MODE FILTER

(71) Applicant: MESAPLEXX PTY LTD, Eight Mile Plains (AU)

(72) Inventors: David Robert Hendry, Brisbane (AU); Steven John Cooper, Brisbane (AU); Peter Blakeborough Kenington, Chepstow (GB)

(73) Assignee: MESAPLEXX PTY LTD, Eight Mile Plains, Queensland (AU)

( * ) Notice: Subject to any disclaimer, the term of this patent is extended or adjusted under 35 U.S.C. 154(b) by 556 days.

(21) Appl. No.: 13/660,628

(22) Filed: Oct. 25, 2012

(65) Prior Publication Data

US 2014/0118095 A1 May 1, 2014

(51) Int. Cl.
*H01P 1/208* (2006.01)
*H01P 7/10* (2006.01)

(52) U.S. Cl.
CPC ..... *H01P 1/2082* (2013.01); *H01P 7/105* (2013.01)

(58) Field of Classification Search
CPC ..... H01P 1/2002; H01P 1/2086; H01P 7/105
USPC ..... 333/219.1, 202
See application file for complete search history.

(56) References Cited

U.S. PATENT DOCUMENTS

| | | | |
|---|---|---|---|
| 2,890,421 | A | 6/1959 | Currie |
| 4,142,164 | A | 2/1979 | Nishikawa et al. |
| 4,614,920 | A | 9/1986 | Tong |
| 4,622,523 | A | 11/1986 | Tang |
| 4,623,857 | A | 11/1986 | Nishikawa et al. |
| 4,630,009 | A | 12/1986 | Tang |
| 4,644,305 | A | 2/1987 | Tang et al. |
| 4,675,630 | A | 6/1987 | Tang et al. |
| 4,792,771 | A | 12/1988 | Siu |
| 5,325,077 | A | 6/1994 | Ishikawa et al. |
| 5,585,331 | A | 12/1996 | Mansour et al. |
| 5,589,807 | A | 12/1996 | Tang |
| 5,710,530 | A | 1/1998 | Wada et al. |
| 5,731,751 | A | 3/1998 | Vangala |

(Continued)

FOREIGN PATENT DOCUMENTS

| | | |
|---|---|---|
| CA | 1189154 | 6/1985 |
| CA | 1194157 A1 | 9/1985 |

(Continued)

OTHER PUBLICATIONS

Guo Qing Luo et al:, Bandwidth-Enhanced Low-Profile Cavity-Backed Slot antenna by Using Hybrid SIW Cavity Modes, IEEE Transactions on Antennas and Propagation, IEEE Service Center, Piscataway, NJ, US, vol. 60, No. 4, Apr. 1, 2012, pp. 1698-1704.

(Continued)

*Primary Examiner* — Robert Pascal
*Assistant Examiner* — Gerald Stevens
(74) *Attorney, Agent, or Firm* — Harrington & Smith

(57) ABSTRACT

The present invention provides a multi-mode cavity filter in which signals are coupled to or from a resonator body, using a coupling path with first and second portions arranged such that current flows in opposite directions and the couplings due to the magnetic fields generated partially cancel one another. In this way, the degree of coupling to any particular mode of the filter can be closely controlled by varying the length and/or orientation of the portions with respect to each other.

25 Claims, 7 Drawing Sheets

(56) References Cited

U.S. PATENT DOCUMENTS

| | | | | |
|---|---|---|---|---|
| 5,805,035 | A | 9/1998 | Accatino et al. | |
| 5,821,837 | A | 10/1998 | Accatino et al. | |
| 6,005,457 | A | 12/1999 | Wu | |
| 6,066,996 | A | 5/2000 | Goertz et al. | |
| 6,072,378 | A | 6/2000 | Kurisu et al. | |
| 6,278,344 | B1 | 8/2001 | Kurisu et al. | |
| 6,359,534 | B2 | 3/2002 | Hunter | |
| 6,462,629 | B1 | 10/2002 | Blair et al. | |
| 6,507,254 | B1 | 1/2003 | Hattori et al. | |
| 6,762,658 | B1 | 7/2004 | Isomura et al. | |
| 6,834,429 | B2 | 12/2004 | Blair et al. | |
| 6,853,271 | B2 | 2/2005 | Wilber et al. | |
| 6,897,741 | B2 | 5/2005 | Ando et al. | |
| 6,954,122 | B2 | 10/2005 | Wilber et al. | |
| 7,042,314 | B2 | 5/2006 | Wang et al. | |
| 7,068,127 | B2 | 6/2006 | Wilber et al. | |
| 7,138,891 | B2 | 11/2006 | Andoh et al. | |
| 7,605,678 | B2 | 10/2009 | Ando et al. | |
| 7,755,456 | B2 | 7/2010 | Salehi | |
| 8,022,792 | B2 | 9/2011 | Howard | |
| 2002/0024410 | A1 * | 2/2002 | Guglielmi et al. | 333/202 |
| 2003/0006864 | A1 | 1/2003 | Hattori et al. | |
| 2003/0141948 | A1 | 7/2003 | Maekawa et al. | |
| 2004/0041660 | A1 | 3/2004 | Kawahara et al. | |
| 2006/0139127 | A1 | 6/2006 | Wada et al. | |
| 2008/0061905 | A1 | 3/2008 | Ishikawa | |
| 2010/0231323 | A1 | 9/2010 | Vangala et al. | |
| 2011/0006856 | A1 | 1/2011 | Kim et al. | |
| 2011/0128097 | A1 | 6/2011 | Park et al. | |

FOREIGN PATENT DOCUMENTS

| | | | |
|---|---|---|---|
| EP | 0883203 | A2 | 12/1998 |
| EP | 0997973 | A1 | 5/2000 |
| EP | 0751579 | B1 | 11/2002 |
| EP | 0656670 | B1 | 1/2003 |
| EP | 1458051 | A1 | 9/2004 |
| GB | 2409344 | A | 6/2005 |
| JP | H0216801 | A | 1/1990 |
| JP | 1079636 | | 3/1998 |
| JP | 10209808 | | 8/1998 |
| JP | H-10224113 | A | 8/1998 |
| JP | H-10284988 | A | 10/1998 |
| JP | H-10294644 | A | 11/1998 |
| JP | H-10322161 | A | 12/1998 |
| JP | 2000295072 | A | 10/2000 |
| JP | 2001060804 | A | 3/2001 |
| JP | 2001060805 | A | 3/2001 |
| JP | 2001160702 | A | 6/2001 |
| JP | 2002151906 | A | 5/2002 |
| JP | 2002217663 | A | 8/2002 |
| JP | 2003037476 | A | 2/2003 |
| JP | 2003188617 | A | 7/2003 |
| JP | 2003234635 | A | 8/2003 |
| JP | 2004312287 | A | 11/2004 |
| JP | 2004312288 | A | 11/2004 |
| JP | 2005065040 | A | 3/2005 |
| JP | 2005167577 | A | 6/2005 |
| JP | 2005223721 | A | 8/2005 |
| WO | 9301626 | A1 | 1/1993 |
| WO | 0077883 | A1 | 12/2000 |
| WO | 02078119 | A1 | 10/2002 |
| WO | 2009029282 | A1 | 3/2009 |
| WO | WO 2010/032791 | A1 | 3/2010 |

OTHER PUBLICATIONS

Guo Qing Luo et al., A :F~]unction power divider FED circularly polarized cavity backed slot antenna, Microwave and Optical Technology Letters, vol. 54, No. 1, Jan. 22, 2012, pp. 107-109.

Guo Qing Luo et al., Development of Low Profile Cavity Backed Crossed Slot Antennas for Planar Integration, IEEE Transactions on Antennas and Propagation, IEEE Service Center, Piscataway, NJ, US, vol. 57, No. 10, Oct. 1, 2009, pp. 2972-2979, XP011276144.

Sarrazin J et al., Pattern Reconfigurable Cubic Antenna, IEEE Transactions on Antennas and Propagation, IEEE Service Center, Piscataway, NJ, US, vol. 57, No. 2, Feb. 1, 2009, pp. 310-317.

Yaaid Yusuf et al., Compact Low-Loss Integration of High-Q 3-D Filters With Highly Efficient Antennas, IEEE Transactions on Microwave Theory and Techniques, IEEE Service Center, Piscataway, NJ, US, vol. 59, No. 4, Apr. 1, 2011, pp. 857-865.

Awai, Ikuo, et al; Equivalent-Circuit Representation and Explanation of Attenuation Poles of a Dual-Mode Dielectric-Resonator Bandpass Filter; Transactions on Microwave Theory and Techniques; (Dec. 1998); pp. 2159-2163; vol. 46; No. 12; IEEE.

awai, iKUO, et al; Coupling of Dual Modes in a Dielectric Waveguide Resonator and it's Application to Bandpass Filters; Proceedings of the 25TH European Microwave Conference; (1995); pp. 533-537; Conf. 25; Yamaguchi University, Japan.

Weily, Andrew R, et al; Rotationally Symmetric FDTD for Fast Design and Wideband Spurious Performance Prediction of Dielectric Resonator Filters; Telecom Group, Falculty of Engineering, University of Technology; (1999); pp. 844-847.

Chaudhary, Raghvendra Kumar, et al.; Multi-Layer Multi-Permittivity Dielectric Resonator: A New Approach for Improved Spurious Free Window; Proceedings of the 40TH European Microwave Conference; (Sep. 28-30, 2010); pp. 1194-1197; Paris, France.

Sano, Kazuhisa, et al.; Application of the Planar I/O Terminal to Dual Mode Dielectric Waveguide Filters; International Microwave Symposium Digest; (Jun. 11-16, 2000); pp. 1173-1176; Boston, MA.

Wang, Chi, et al; A Practical Triple-Mode Monoblock Bandpass Filter for Base Station Applications; MTT-S Digest; (2001); pp. 1783-1786.

Awai, Ikuo, et al; A Dual Mode Dielectri Waveguide Resonator and its Application to Bandpass Filters; IEICE Transactions on Electronics; (Aug. 1995); pp. 1018-1025; vol. E78-C; No. 8.

Bekheit, Maged, et al.; Modeling and Optimization of Compact Microwave Bandpass Filters; IEEE Transactions of Microwave Theory and Techniques; (Feb. 2008); pp. 420-430; vol. 56; No. 2.

R1-110591; Research in Motion, UK Limited; "Some Design Consideration for CoMP Scenario 4"; 3GPP TSG RAN WG1 Meeting #64; Taipei, Taiwan, Feb. 21-25, 2011.

R1-110649; Ericsson; "Aspects on Distributed RRUs with Shared Cell-ID for Heterogeneous Deployments"; 3GPP TSG-RAN WG1 #64; Taipei, Taiwan, Feb. 21-Feb. 25, 2011.

R1-111029; Nokia Siemens Networks, Nokia; "Further details on CoMP scenarios"; 3GPP TSG-RAN WG1 Meeting #64; Taipei, Taiwan, Feb. 21-25, 2011.

* cited by examiner

MULTI-MODE FILTER

The present invention relates to filters, and in particular to a multi-mode filter including a resonator body for use, for example, in frequency division duplexers for telecommunication applications.

BACKGROUND

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

All physical filters essentially consist of a number of energy storing resonant structures, with paths for energy to flow between the various resonators and between the resonators and the input/output ports. The physical implementation of the resonators and the manner of their interconnections will vary from type to type, but the same basic concept applies to all. Such a filter can be described mathematically in terms of a network of resonators coupled together, although the mathematical topography does not have to match the topography of the real filter.

Conventional single-mode filters formed from dielectric resonators are known. Dielectric resonators have high-Q (low loss) characteristics which enable highly selective filters having a reduced size compared to cavity filters. These single-mode filters tend to be built as a cascade of separated physical dielectric resonators, with various couplings between them and to the ports. These resonators are easily identified as distinct physical objects, and the couplings tend also to be easily identified.

Single-mode filters of this type may include a network of discrete resonators formed from ceramic materials in a "puck" shape, where each resonator has a single dominant resonance frequency, or mode. These resonators are coupled together by providing openings between cavities in which the resonators are located. Typically, the resonators provide transmission poles or "zeros", which can be tuned at particular frequencies to provide a desired filter response. A number of resonators will usually be required to achieve suitable filtering characteristics for commercial applications, resulting in filtering equipment of a relatively large size.

One example application of filters formed from dielectric resonators is in frequency division duplexers for microwave telecommunication applications. Duplexers have traditionally been provided at base stations at the bottom of antenna supporting towers, although a current trend for microwave telecommunication system design is to locate filtering and signal processing equipment at the top of the tower to thereby minimise cabling lengths and thus reduce signal losses. However, the size of single mode filters as described above can make these undesirable for implementation at the top of antenna towers.

Multi-mode filters implement several resonators in a single physical body, such that reductions in filter size can be obtained. As an example, a silvered dielectric body can resonate in many different modes. Each of these modes can act as one of the resonators in a filter. In order to provide a practical multi-mode filter it is necessary to couple the energy between the modes within the body, in contrast with the coupling between discrete objects in single mode filters, which is easier to control in practice.

The usual manner in which these multi-mode filters are implemented is to selectively couple the energy from an input port to a first one of the modes. The energy stored in the first mode is then coupled to different modes within the resonator by introducing specific defects into the shape of the body. In this manner, a multi-mode filter can be implemented as an effective cascade of resonators, in a similar way to conventional single mode filter implementations. Again, this technique results in transmission poles which can be tuned to provide a desired filter response.

An example of such an approach is described in U.S. Pat. No. 6,853,271, which is directed towards a triple-mode mono-body filter. Energy is coupled into a first mode of a dielectric-filled mono-body resonator, using a suitably configured input probe provided in a hole formed on a face of the resonator. The coupling between this first mode and two other modes of the resonator is accomplished by selectively providing corner cuts or slots on the resonator body.

This technique allows for substantial reductions in filter size because a triple-mode filter of this type represents the equivalent of a single-mode filter composed of three discrete single mode resonators. However, the approach used to couple energy into and out of the resonator, and between the modes within the resonator to provide the effective resonator cascade, requires the body to be of complicated shape, increasing manufacturing costs.

Two or more triple-mode filters may still need to be cascaded together to provide a filter assembly with suitable filtering characteristics. As described in U.S. Pat. Nos. 6,853,271 and 7,042,314 this may be achieved using a waveguide or aperture for providing coupling between two resonator mono-bodies. Another approach includes using a single-mode combline resonator coupled between two dielectric mono-bodies to form a hybrid filter assembly as described in U.S. Pat. No. 6,954,122. In any case the physical complexity and hence manufacturing costs are even further increased.

SUMMARY OF INVENTION

The present invention provides a multi-mode cavity filter in which signals are coupled to or from a resonator body, using a coupling path with first and second portions arranged such that current flows in opposite directions and the magnetic fields generated produce couplings of opposite sign which therefore partially cancel one another. In this way, the degree of coupling to any particular mode of the filter can be closely controlled by varying the length and/or orientation of the portions with respect to each other.

A multi-mode cavity filter, comprising: a dielectric resonator body incorporating a piece of dielectric material, the piece of dielectric material having a shape such that it can support at least a first resonant mode and a second substantially degenerate resonant mode; and a coupling structure comprising a first coupling portion and a second coupling portion coupled to a common input or output connection, the first coupling portion being arranged to generate a first magnetic field for coupling to at least one of the first resonant mode and the second resonant mode within the dielectric resonator body, the second coupling portion being arranged to generate a second magnetic field for coupling to at least one of the first resonant mode and the second resonant mode within the dielectric resonator body, the second magnetic field having a magnitude and a direction so as to partially cancel the coupling due to the first magnetic field.

BRIEF DESCRIPTION OF THE DRAWINGS

For a better understanding of the present invention, and to show more clearly how it may be carried into effect, reference will now be made, by way of example, to the following drawings, in which.

DETAILED DESCRIPTION

Figure 1A:
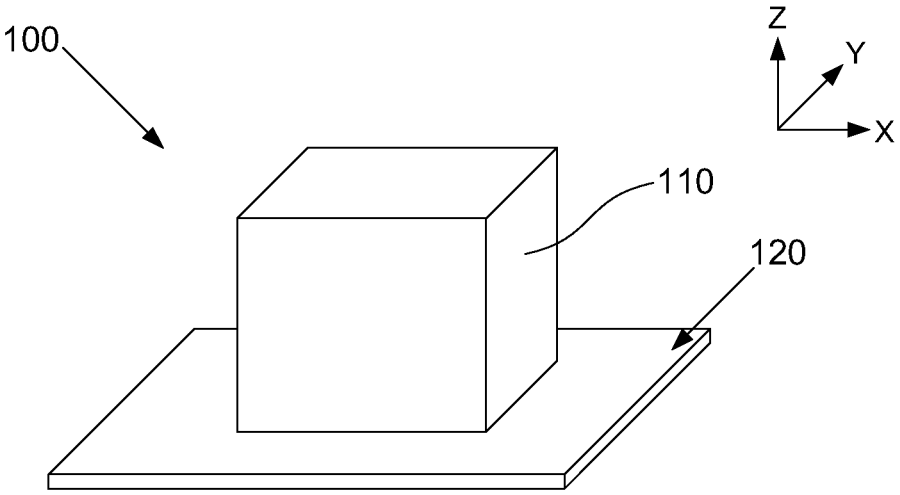
FIGS. 1A to 1E show a multi-mode filter according to embodiments of the invention.
Figure 1B:
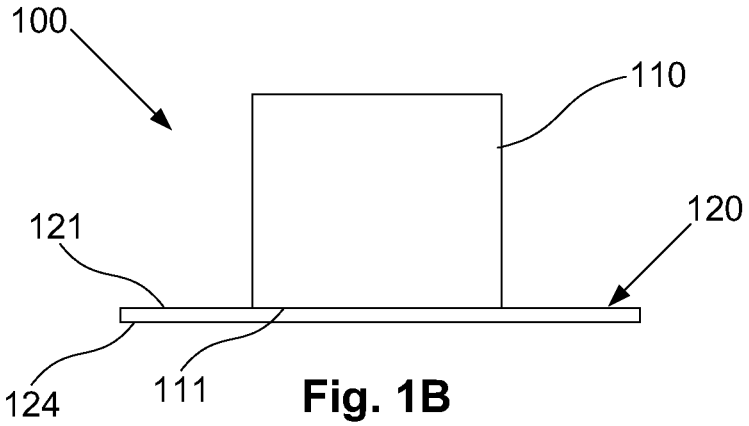
Figure 1C:
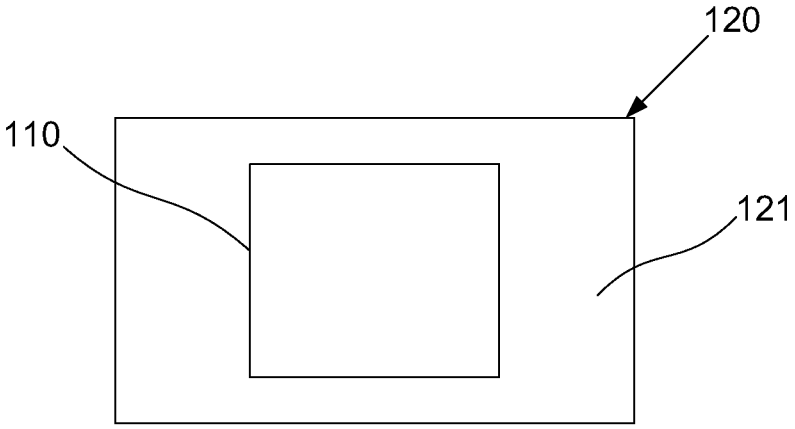

An example of a multi-mode filter will now be described with reference to FIGS. 1A to 1E.

In this example, the filter 100 includes a resonator body 110, and a coupling structure 130. The coupling structure 130 comprises at least one coupling path 131, 132, which includes an electrically conductive resonator path extending adjacent to at least part of a surface 111 of the resonator body 110, so that the coupling structure 130 provides coupling to a plurality of the resonance modes of the resonator body.

In use, a signal can be supplied to or received from the at least one coupling path 131, 132. In a suitable configuration, this allows a signal to be filtered to be supplied to the resonator body 110 for filtering, or can allow a filtered signal to be obtained from the resonator body, as will be described in more detail below.

The use of electrically conductive coupling paths 131, 132 extending adjacent to the surface 111 allows the signal to be coupled to a plurality of resonance modes of the resonator body 110 in parallel. This allows a simpler configuration of resonator body 110 and coupling structures 130 to be used as compared to traditional arrangements. For example, this avoids the need to have a resonator body including cut-outs or other complicated shapes, as well as avoiding the need for coupling structures that extend a precise distance into the resonator body. This, in turn, makes the filter cheaper and simpler to manufacture, and can provide enhanced filtering characteristics. In addition, the filter is small in size, typically of the order of 6000 $mm^3$ per resonator body, making the filter apparatus suitable for use at the top of antenna towers.

A number of further features will now be described.

In the above example, the coupling structure 130 includes two coupling paths 131, 132, coupled to an input 141 and an output 142, thereby allowing the coupling paths to act as input and output coupling paths respectively. In this instance, a signal supplied via the input 141 couples to the resonance modes of the resonator body 110, so that a filtered signal is obtained via the output 142. However, the use of two coupling paths is for the purpose of example only, and one or more coupling paths may be used depending on the preferred implementation.

For example, a single coupling path 131, 132 may be used if a signal is otherwise coupled to the resonator body 110. This can be achieved if the resonator body 110 is positioned in contact with, and hence is coupled to, another resonator body, thereby allowing signals to be received from or supplied to the other resonator body. Coupling structures may also include more coupling paths, for example if multiple inputs and/or outputs are to be provided, although alternatively multiple inputs and/or outputs may be coupled to a single coupling path, thereby allowing multiple inputs and/or outputs to be accommodated.

Alternatively, multiple coupling structures 130 may be provided, with each coupling structure 130 having one or more coupling paths. In this instance, different coupling structures can be provided on different surfaces of the resonator body. A further alternative is for a coupling structure to extend over multiple surfaces of the resonator body, with different coupling paths being provided on different surfaces, or with coupling paths extending over multiple surfaces. Such arrangements can be used to allow a particular configuration of input and output to be accommodated, for example to meet physical constraints associated with other equipment, or to allow alternative coupling arrangements to be provided. In use, a configuration of the input and output coupling paths 131, 132, along with the configuration of the resonator body 110 controls a degree of coupling with each of the plurality of resonance modes and hence the properties of the filter, such as the frequency response.

The degree of coupling depends on a number of factors, such as a coupling path width, a coupling path length, a coupling path shape, a coupling path position, a coupling path direction relative to the resonance modes of the resonator body, a size of the resonator body, a shape of the resonator body and electromagnetic properties of the resonator body, such as permittivity and permeability. A number of these factors will be described in greater detail below. It will therefore be appreciated that the example coupling structure and cube configuration of the resonator body is for the purpose of example only, and is not intended to be limiting.

The resonator body 110 includes an external coating of conductive material 114, such as silver, although other materials could be used such as gold, copper, or the like. The conductive material may be applied to one or more surfaces of the body. A region 116 of the surface adjacent to the coupling structure 130 may be uncoated to allow coupling of signals to the resonator body 110.

Figure 1D:
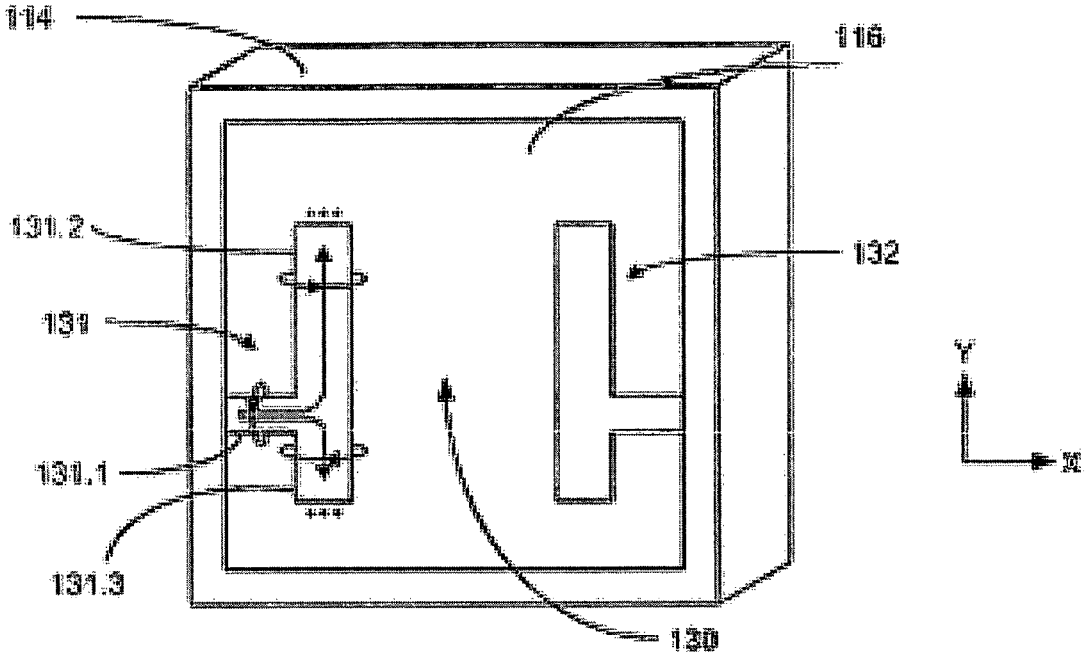
Figure 1E:
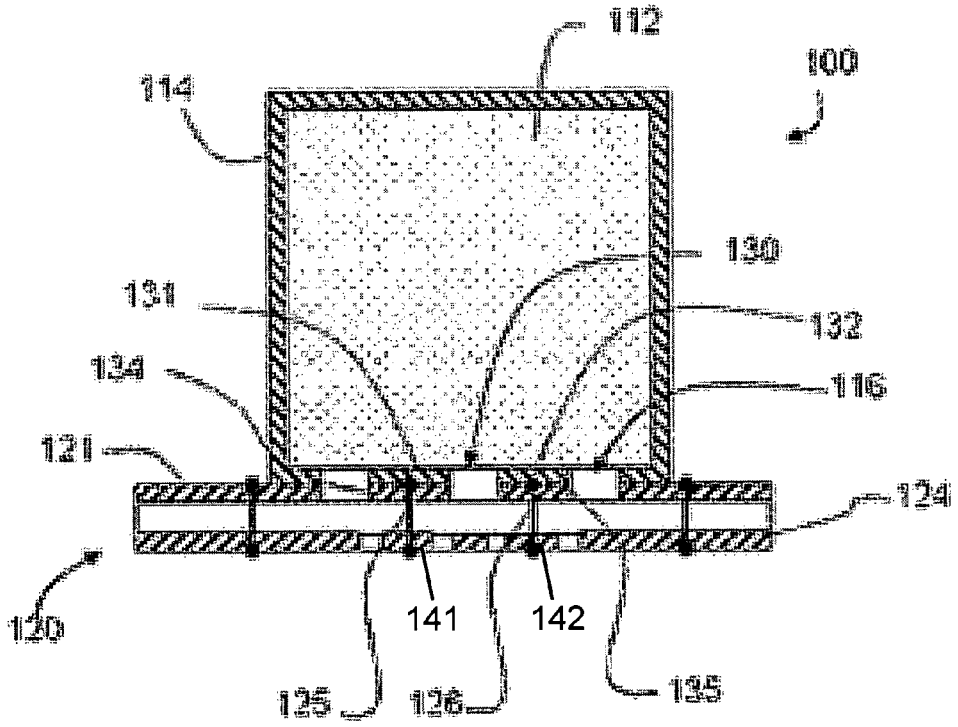

In the illustrated embodiment, the coupling structure 130 is provided on a surface of the dielectric resonator 112 directly, as shown in FIGS. 1D and 1E. That is, the resonator body 110 may be coated in a layer 114 of conductive material as described above; a coupling structure according to embodiments of the present invention can then be patterned into the layer of conductive material, and coupled to connection pads 134, 135 on an uppermost surface of the substrate 120. In that case, the coupling between the substrate 120 and the coupling structure on the resonator body may be provided by way of solder ball contacts or any other suitable means. The coupling structure can be formed using one of the standard techniques known to those skilled in the art, such as by patterning a mask (using printing techniques or photoresist) and then etching the exposed parts to create the coupling structure. Alternatively the coupling structure may be created by milling (e.g. laser milling, mechanical milling, etc) into the conductive layer surrounding the resonator body 110.

Alternatively, the coupling structure 130 may be provided on the substrate 120. In that case, the coupling structure can be formed in an upper conductive layer of the substrate using any of the standard techniques known to those skilled in the art, such as by patterning a mask in the layer (using printing techniques or photoresist) and then etching the exposed parts to create one or more cut-outs, or by milling the conductive layer.

The resonator body can be any shape, but generally defines at least two orthogonal axes, with the coupling paths extending at least partially in the direction of each axis, to thereby provide coupling to multiple separate resonance modes.

Figure 2A:
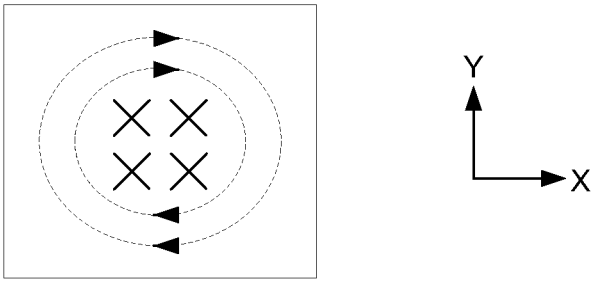
FIGS. 2A to 2C show resonant modes of a resonator body.
Figure 2B:
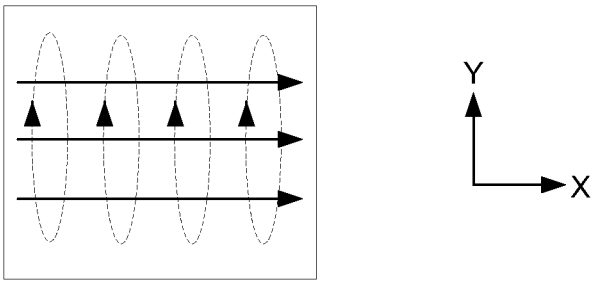
Figure 2C:
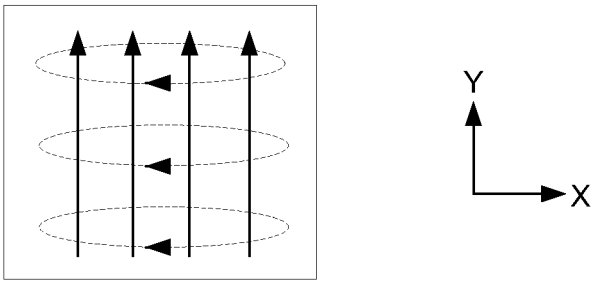

In the current example, the resonator body 110 is a cuboid body, and therefore defines three orthogonal axes substantially aligned with surfaces of the resonator body, as shown by the axes X, Y, Z. As a result, the resonator body 110 has three dominant resonance modes that are substantially orthogonal and whose electric fields are substantially aligned with the three orthogonal axes. Examples of the different resonance modes are shown in FIGS. 2A to 2C, which show magnetic and electrical fields in dotted and solid lines respectively, with the resonance modes being generally referred to as TM110, TE011 and TE101 modes, respectively.

Cuboid structures are particularly advantageous as they can be easily and cheaply manufactured, and can also be easily fitted together, for example by arranging multiple resonator bodies in contact. Cuboid structures typically have clearly defined resonance modes, making configuration of the coupling structure more straightforward. Additionally, the use of a cuboid structure provides a planar surface 111 so that the coupling structure 130 can be arranged in a plane parallel to the planar surface 111, with the coupling structure 130 optionally being in contact with the resonator body 110. This can help maximise coupling between the coupling structure 130 and resonator body 110, as well as allowing the coupling structure 130 to be more easily manufactured.

The provision of a planar surface 111 allows the substrate 120 to be a planar substrate, such as a printed circuit board (PCB) or the like. In the illustrated embodiment (see FIG. 1E in particular), the PCB substrate 120 has three layers. However, it will be apparent to those skilled in the art that the PCB 120 may comprise any number of further layers (for example, providing a power layer, or further ground layers) without departing from the scope of the present invention. Note that the phrase "number of layers" as used herein refers to the number of conductive layers as is the convention in the art. Each conductive layer is separated by a non-conductive layer of, for example, a material having low dielectric constant.

An uppermost layer (i.e. one of the outermost layers) of the PCB substrate 120 comprises a ground plane 121 having an aperture through which signals can be transferred to and/or from the resonator body 110. In the illustrated embodiment, the aperture in the substrate ground plane 121 substantially corresponds in size and shape to the aperture 116 in the conductive layer 114 covering the resonator body 110. In other embodiments, the aperture in the substrate ground plane 121 may correspond in shape to the aperture 116 in the conductive layer 114, but have a greater or smaller size. Connection pads 134, 135 (or, in alternative embodiments, the coupling structure 130 itself) are arranged within the aperture. These are electrically coupled by connections 125, 126 to the input and output connections 141, 142 such that signals can be passed to and from the resonator body 110. The connections 125, 126 may be standard vias or plated through-holes, as will be familiar to those skilled in the art. However, the input and output paths 141, 142 can be coupled to the coupling structure 130 using any suitable technique, such as capacitive or inductive coupling.

The bottom layer comprises a further ground plane 124, which is arranged so as to cover the aperture 116 as will be described in further detail.

The conductive layer 114 covering the resonator body 110 is electrically connected to the upper ground plane 121. Solder is suitable for this task as it provides both electrical and mechanical connection, but any other suitable connection mechanism may be employed. The upper ground plane 121 is further electrically coupled to the lower ground plane 124, which extends over the aperture 116 (albeit at a position removed from the aperture itself). In this manner, a near continuous ground plane is established around the dielectric resonator 112, and energy leakage from the filter 100 is reduced or minimized. The conductive layer 114 surrounding the resonator 112 prevents energy from radiating out of the dielectric material from surfaces on which the conductive layer 114 is present. The electrical coupling between the upper and lower ground planes 121, 124 prevents energy from leaking out of the aperture 116, except of course the controlled extraction of energy by the coupling structure 130 corresponding to output signals.

The manner of the electrical coupling between the upper and lower ground planes 121, 124 may vary according to the frequencies of the input and output signals. That is, in one embodiment the upper and lower ground planes 121, 124 are coupled to each other by one or more electrical connections such as vias or plated through holes, as will be familiar to those skilled in the art. The electrical connections may be distributed so as to largely correspond with the boundary of the aperture 116. However, the number and type of such electrical connections, as well as their precise positioning, may be altered according to the frequencies of the signals which will be input to and/or output from the resonator body 110. If sufficient connections are used, based upon the frequencies present in the circuit, then the lower ground plane 124 forms the final (i.e. $6^{th}$ in the illustrated embodiment) conductive side to the resonator 'box'. This grounded, conductive, side acts as a reflector, in the same manner as the metallised sides of the resonator body 110. The electromagnetic energy is therefore kept within the structure and prevented from radiating outwards.

In alternative embodiments an upper ground plane may not be provided (i.e. on the upper layer of the substrate), in which case the coupling structure 130 could be formed from conductive material applied to the substrate 120. In this instance, the coupling structure 130 can still be electrically coupled to ground, for example through vias or other connections provided on the substrate.

The input or output may in turn be coupled to additional connections depending on the intended application. For example, the input and output paths 141, 142 could be connected to an edge-mount SMA coaxial connector, a direct coaxial cable connection, a surface mount coaxial connection, a chassis mounted coaxial connector, or a solder pad to allow the filter 100 to be directly soldered to another PCB, with the method chosen depending on the intended application. Alternatively the filter could be integrated into the PCB of other components of a communications system.

In use, the coupled resonance modes of the resonator body provide respective energy paths between the input and output. Furthermore, the input coupling path and the output coupling path can be configured to allow coupling therebetween to provide an energy path separate to energy paths provided by the resonance modes of the resonator body. This can provide four parallel energy paths between the input and the output. These energy paths can be arranged to introduce at least one transmission zero to the frequency response of the filter. In this regard, the term "zero" refers to a transmission minimum in the frequency response of the filter, meaning transmission of signals at that frequency will be minimal, as will be understood by persons skilled in the art.

As described above, the filtering performance of the filter 100 is dependent to a large degree on the coupling structure 130 (although other factors also play important roles). For example, particular shapes and orientations of the coupling structure may couple more strongly to one mode of resonance than the other modes. It is therefore important to design the coupling structures with care in order to maintain close control over the filter and to achieve a particular desired filtering performance. Embodiments of the present invention provide coupling structures and methods for designing coupling structures in which the degree of coupling with any particular resonant mode can be controlled by appropriate design of the coupling structure. In particular, the degree of coupling afforded by one portion of the coupling structure is partially cancelled by the degree of coupling afforded by another portion of the coupling structure. This allows one coupling strength (say to a first resonant mode) to be set to the desired value without an undesired strength of coupling occurring to another mode (to a second resonant mode). The extra degree of freedom provided by the second portion allows a solution to be found that satisfies the requirements for controlled coupling to multiple modes.

Example coupling structures will now be described with reference to FIGS. 1D and 3 to 9. It will be appreciated that, although illustrated on the resonator body 110, the coupling structures may alternatively be formed in the substrate 120 as described above.

FIG. 1D illustrates a coupling structure 130 according to embodiments of the present invention. The coupling structure 130 comprises an input coupling path 131 and an output coupling path 132. In the illustrated embodiment, these paths are mirror images of each other and lie on the same surface (face) of the resonator body 110, with a plane of symmetry running through the centre of the resonator body 110. However, it will be understood that in general the input and output coupling paths can have different shapes or be connected to different surfaces of the resonator body 110. In other embodiments, a single coupling path may be provided (i.e. to an input or an output). Only the input coupling path 131 will be described in detail here.

The input coupling path 131 comprises a track of conductive material having three components: a first, connecting portion 131.1 which connects the coupling path to the conductive covering 114 at the edge of the window 116; a second, strong-coupling portion 131.2 connected to the end of the connecting portion 131.1; and a third, weak-coupling portion 131.3 which is also connected to the end of the connecting portion 131.1. The connecting portion 131.1 extends substantially in the X-direction; the strong-coupling portion 131.2 extends substantially in the Y-direction; and the weak-coupling portion 131.3 extends substantially in the opposite direction to the strong-coupling portion 131.2 (i.e. but also in the Y-direction).

Also shown in FIG. 1D (and other figures) is the current flow, and the resultant H-(magnetic) and E-(electric) fields. The current flow is illustrated by arrows drawn along the coupling path 131. The magnetic field lines generated by a current flowing along a conductor are perpendicular to the conductor and lie in rings around the conductor; these field lines (and the direction of the field) are also shown by appropriate arrows. The electric field projects from the ends of the coupling path 131, i.e. the ends of the strong-coupling portion 131.2 and the weak-coupling portion 131.3. This field is illustrated at the ends of the coupling path 131 by "+" symbols for a positive electric field, and by "−" symbols for a negative electric field.

It will be apparent from FIG. 1D that the current in the connecting portion 131.1 causes a magnetic field (H) which couples primarily to the X resonant mode of the resonator body 110. The current in the strong-coupling portion 131.2 generates a magnetic field which couples predominantly to the Y resonant mode of the resonator body. In some embodiments, the conductive path from the edge of the window 116, through the connecting portion 131.1, to the open-circuit end of the strong-coupling portion 131.2 is such so as to resonate at a particular operating frequency of the filter 100. For example, this conductive path can be equal in length to a quarter of the wavelength of the resonant wavelength of the resonator body. In these circumstances, the current in the strong-coupling portion 131.2 is at a maximum, the magnetic field generated by the current is at a maximum, and therefore the coupling to the Y mode is at a maximum (i.e. strong coupling will occur to the Y mode).

The current in the weak-coupling portion 131.3 is also along the Y axis, but in a direction which is opposite that of the current in the strong-coupling portion 131.2. The current in the weak-coupling portion 131.3 therefore generates a magnetic field which is in an opposite direction (i.e. which circles in an opposite direction) to that generated by the strong-coupling portion 131.2 and which partially cancels that magnetic field, so that the coupling to the Y mode due to the first portion partially cancels the coupling to the Y mode due to the second portion. In embodiments of the invention, the conductive path through the connection portion 131.1 to the open-circuit end of the weak-coupling portion 131.3 has a different length to that of the strong-coupling portion 131.2, and a greater current flows in the strong-coupling portion 131.2 than in the weak-coupling portion 131.3. In operation, the magnetic field generated by the current in the weak-coupling portion has a lower magnitude than that generated by the strong-coupling portion, and therefore there is only partial cancellation of the coupling due to the magnetic field.

In the absence of the weak-coupling portion 131.3, a filter designer may find that the coupling to a particular mode (the Y mode in this case) is too strong and this could result in the filter failing to meet the desired specification. The weak-coupling portion 131.3 therefore provides a degree of control, by conducting a smaller current and generating a weaker magnetic field in an opposite direction. As a result, the coupling from the strong coupling portion to the resonant mode in question will be partially cancelled by the coupling from the weak-coupling portion to the resonant mode in question. An electromagnetic simulation tool can be used to optimise the lengths of the strong-coupling portion and the weak-coupling portion in order to meet a given set of design criteria. In some cases, the 'strong' and 'weak' coupling portions may need to be close to being equal (both in length and in coupling strength) in order to meet the required set of design criteria.

Returning to FIG. 1D, it can be seen that the electric field will be at respective maxima at the open-circuit ends of the coupling portions and that these maxima will have the same sign at any one time (but not necessarily the same magnitude). Therefore the electric field couplings between the open-circuit ends and the Z mode will have the same sign and so reinforce one another—coupling to the Z mode of the resonator body 110 is therefore strong.

Similarly, the current flowing through the connecting portion 131.1 is in one direction only at any one time and therefore the magnetic field generated is in one direction only. Again, there is no cancellation and the magnetic field generated by the connecting portion 131.1 couples to the X mode.

Figure 3:
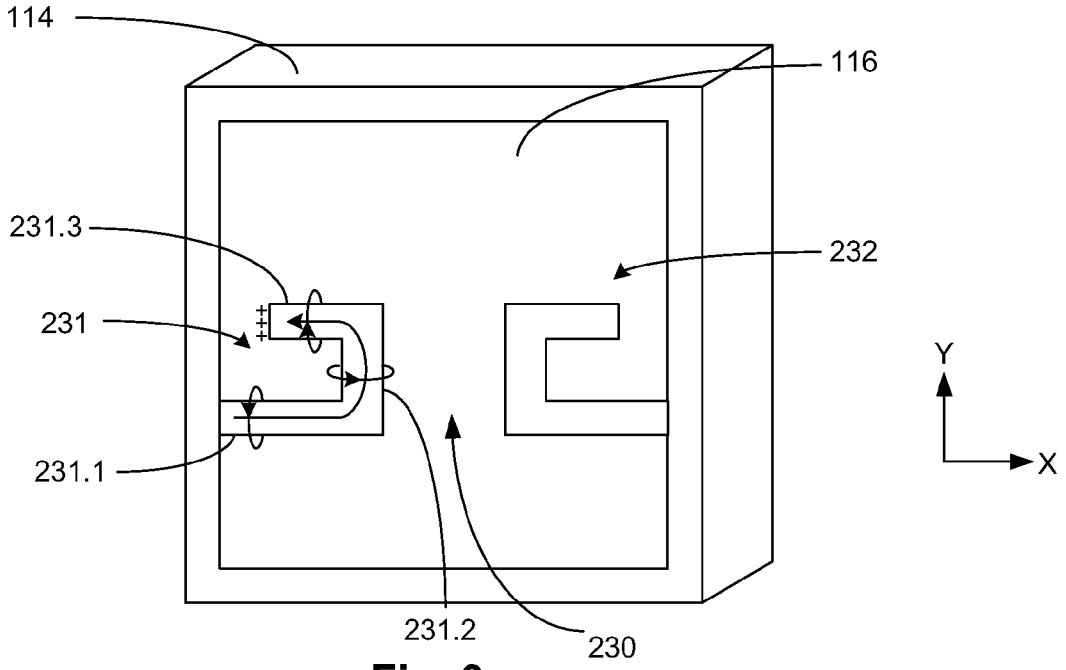
FIGS. 3 to 9 show coupling structures according to embodiments of the invention.

FIG. 3 shows a coupling structure 230 according to further embodiments of the present invention, comprising an input coupling path 231 and an output coupling path 232. Again, only the input coupling path 231 will be described for brevity, but it will be understood that the principles of the invention apply to input and output coupling paths equally.

The input coupling path 231 comprises three portions: a lower portion 231.1 which is coupled to the conductive layer 114 at the edge of the window 116 and runs in a direction parallel to the X direction; an upper portion 231.3 which also runs parallel to the X direction; and an intermediate portion 231.2 which connects the upper portion to the lower portion and runs parallel to the Y direction.

The current flows along the coupling path 231 from the conductive layer 114 to the open-circuit end of the upper portion 231.3. In the lower portion, the current runs in the X direction and generates a corresponding H field (for coupling to the X mode of the resonator body 110). In the intermediate portion 231.2, the current runs in the Y direction and generates a corresponding H field for coupling to the Y mode (orthogonal to and independent of the H fields in the X direction). In the upper portion, the current runs parallel to the Y axis but in a direction which is opposite to that of the current in the lower portion 231.1. The magnetic field generated is therefore in an opposite direction to the magnetic field generated by the lower portion, and the couplings due to the two partially cancel. Moreover, since the upper portion 231.3 is close to the open-circuit end of the input coupling path and shorter than the lower portion 231.1, it therefore has a lower current and generates a weaker magnetic field. Therefore there is only partial cancellation of the couplings due to the two magnetic fields and the degree of coupling to a particular mode (this time the X mode) can be controlled.

It will be apparent to those skilled in the art that coupling paths can be designed in which the degree of coupling to more than one resonant mode of the resonator body 110 can be controlled in the manner described above.

Figure 4:
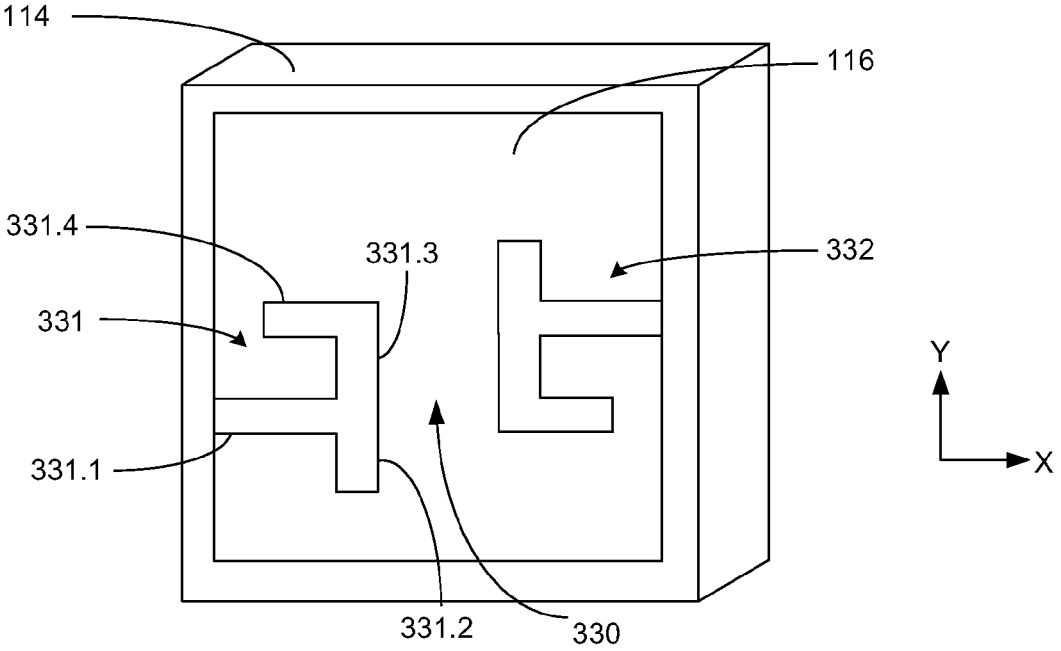

FIG. 4 shows a coupling structure 330 according to further embodiments of the present invention, in which coupling to both the X and Y resonant modes of the resonator body 110 is controlled through the principles of partial field coupling cancellation described above. Although both input and output coupling paths are illustrated, only the input coupling path 331 is described in detail below.

The input coupling path 331 comprises four portions: a connecting portion 331.1 coupled to the conductive layer 114 at the edge of the window 116, extending in the X direction; two further portions 331.2, 331.3 coupled to the end of the connecting portion 331.1, each extending in the Y direction but in opposite directions and having different lengths to each other; and a final portion 331.4 coupled to the end of one of the further portions 331.3, extending in the X direction and having a different length to the connecting portion 331.1.

As will be apparent from the embodiments described above with respect to FIGS. 1D and 3, current flowing along each of these portions generates a corresponding magnetic field. The current in the connecting portion 331.1 generates a magnetic field which couples relatively strongly to the X mode; the smaller current flowing in the final portion 331.4 also generates a magnetic field but this rotates in the opposite direction to that of the connecting portion 331.1. Thus the couplings due to the two fields partially cancel and the degree of coupling to the X mode of resonance can be controlled. In the Y direction, current flowing in the longer further portion 331.3 generates a magnetic field which couples to the Y modes of resonance; the smaller current in the shorter further portion 331.2 (with the open-circuit end) generates a smaller magnetic field in the opposite direction, and the partial cancellation between the two gives the designer a good degree of control over the coupling to the Y mode.

Figure 5:
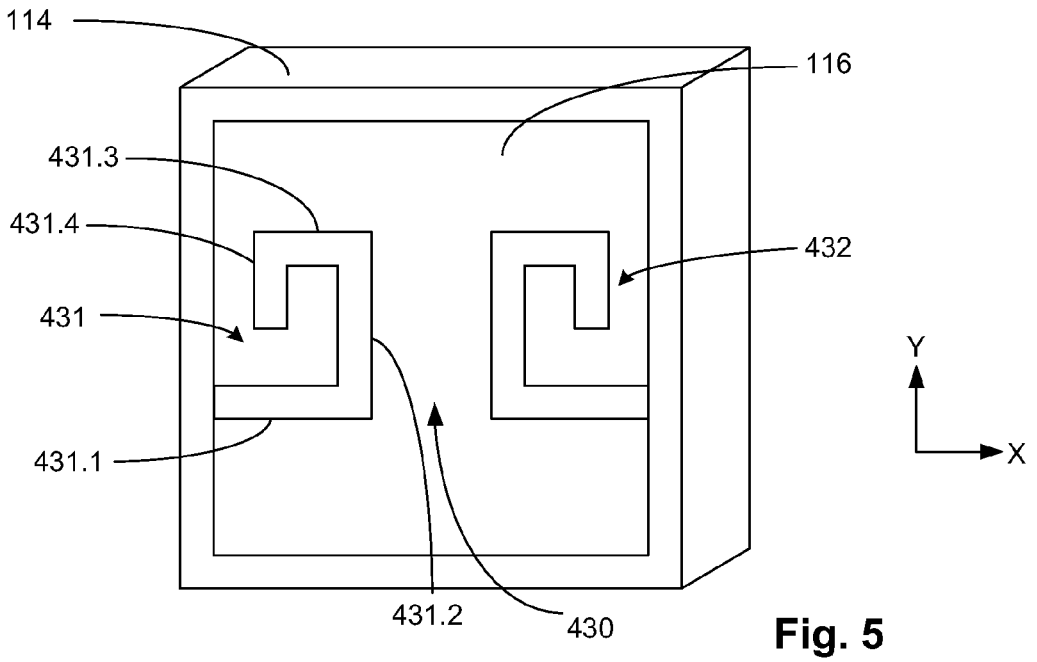

FIG. 5 shows another coupling structure 430 according to embodiments of the present invention, in which coupling to both X and Y modes is controlled through the principle of partial coupling cancellation of magnetic fields. Again, the coupling structure comprises input 431 and output coupling paths 432, but only the input coupling path 431 is described in detail.

The input coupling path 431 again comprises four portions: a connecting portion 431.1 coupled to the conductive layer 114 at the edge of the window 116, extending in the X direction; a first intermediate portion 431.2 coupled to the end of the connecting portion 431.1, extending in the Y direction; a second intermediate portion 431.3 coupled to the end of the first intermediate portion 431.2, extending in the X direction but in an opposite direction to the connecting portion 431.1; and a final portion 431.4 coupled to the end of the second intermediate portion 431.3, extending in the Y direction but in an opposite direction to the first intermediate portion 431.2. It will be apparent from the discussions above that the magnetic fields generated by current flowing in the connecting portion 431.1 and in the second intermediate portion 431.3 are in opposite directions and the couplings due to these partially cancel one another. Similarly, the magnetic fields generated by current flowing in the first intermediate portion 431.2 and the final portion 431.4 are in opposite directions and the couplings partially cancel one another. In this way, coupling to both the X and Y resonant modes in the resonator body 110 can be closely controlled.

Note that the input and output coupling paths need not be oriented in the same way (i.e. mirror images of each other), and nor do they need to be of the same design/shape as each other.

Figure 6:
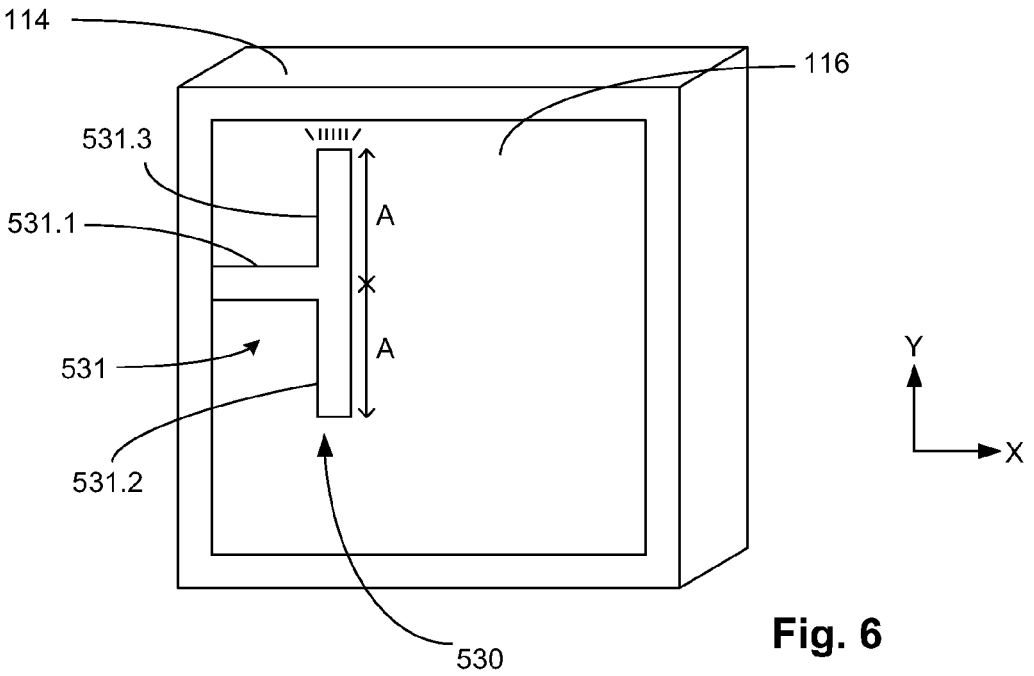

FIG. 6 shows a coupling structure 530 according to embodiments of the present invention with a single input/output coupling path 531. The coupling path 531 comprises three portions: a connecting portion 531.1 coupled to the conductive layer 114 at the edge of the window 116, extending in the X direction; a strong-coupling portion 531.3 connected to the end of the connecting portion 531.1, extending in the Y direction; and a weak-coupling portion 531.2 also connected to the end of the connecting portion 531.1 and extending in the Y direction but opposite to the strong-coupling portion. It will immediately be apparent from a review of the drawing that both the weak-coupling portion 531.2 and the strong-coupling portion 531.3 have the same length and therefore the same response to input/output signals of a particular wavelength. Under ordinary circumstances, it might be supposed that the current is therefore equal and opposite in each coupling portion 531.2, 531.3 and, rather than achieving partial coupling cancellation, the magnetic field couplings would completely cancel each other and no coupling to the Y mode would take place.

However, in this embodiment the coupling path 531 is offset from the centre of the window 116 such that the open-circuit end of the weak-coupling portion 531.2 is further from an edge of the window 116 than the open-circuit end of the strong-coupling portion 531.3. This placement of an open-circuit end near the (grounded) conductive layer 114 results in charges being induced at the edge of the window 116 through capacitive effects. This effectively increases the amount of current flowing in the strong-coupling portion 531.3 and therefore increases the magnetic field generated by that portion 531.3. The cancellation between the two magnetic field couplings is therefore not total, but partial, and the degree of coupling to the Y mode is controlled.

In the absence of capacitive effects (i.e. if neither open-circuit end is sufficiently near to the edge of the window 116), another effect which varies the relative coupling strengths of two equal length coupling portions is the position of the coupling portions relative to the centre of the cube. In general the electromagnetic field varies from a maximum in the centre of the resonator body 110 to zero at the edges. If one coupling portion is nearer the centre of the cube face than the other then it will have stronger coupling. Thus, in the absence of a capacitive effect in the coupling structure 530, the "weak" coupling portion 531.2 actually couples more strongly than the "strong" coupling portion 531.1.

Figure 7:
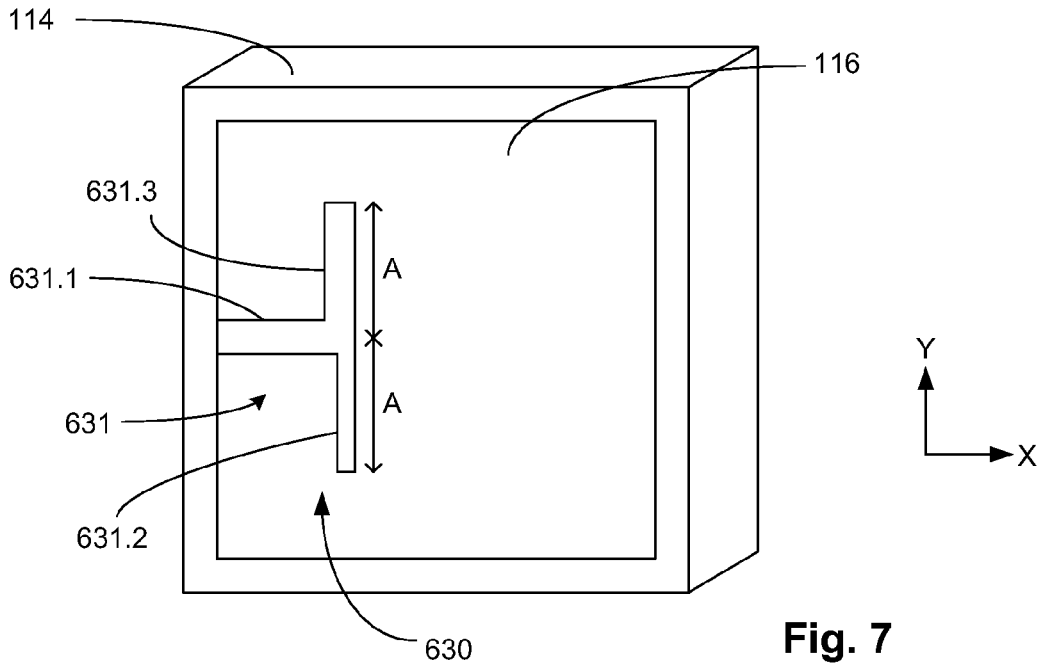

FIG. 7 shows a coupling structure 630 which utilizes a similar effect, albeit with a coupling path 631 which need not be offset from the centre of the window 116. The coupling structure 631 again comprises a connecting portion 631.1 and strong- and weak-coupling portions 631.2, 631.3 extending in opposite directions. The strong-coupling portion 631.2 has the same length as the weak-coupling portion 631.3 and their respective open-circuit ends are the same distance from the edge of the window 116; however, the strong-coupling portion 631.2 is wider than the weak-coupling portion 631.3. Thus the current flowing in the strong-coupling portion 631.2 is greater and the magnetic field generated stronger than in the weak-coupling portion 631.3. Thus the couplings due to the two magnetic fields cancel only partially and control is exerted over the degree of coupling to the Y mode. Note that it is not necessary for the respective open-circuit ends of the strong-coupling portion 631.2 and the weak-coupling portion 631.3 to be the same distance from the edge of the window 116, so long as both ends are sufficiently far from the window edge that the capacitive effects discussed with reference to FIG. 6, are negligible in relation to the differential current-flow effects discussed above.

Figure 8:
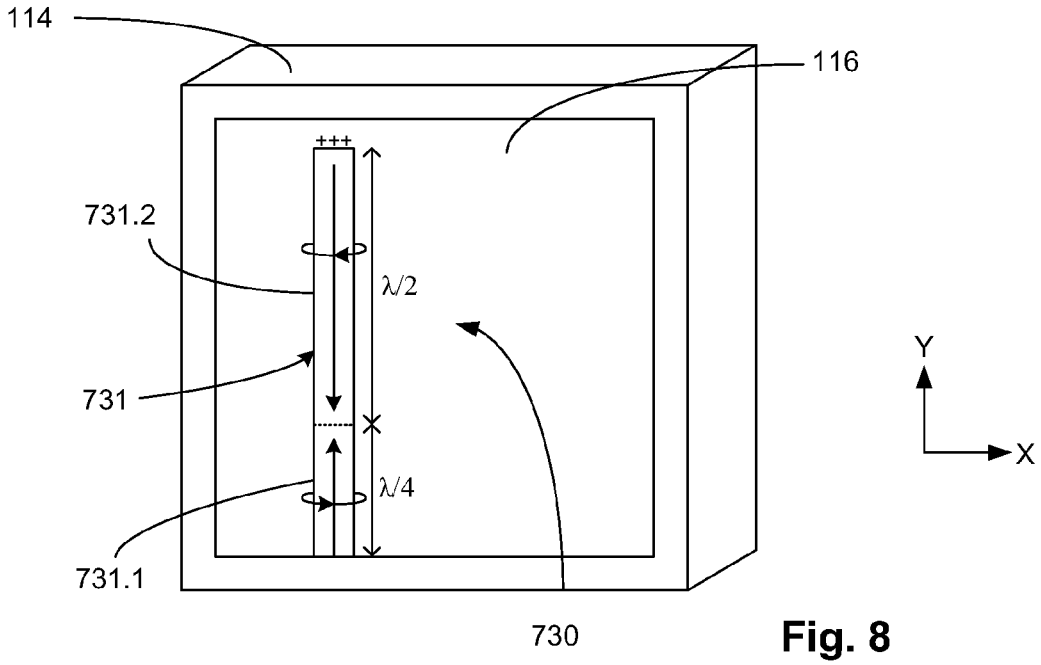

It will be apparent from the coupling structures described above that the present invention provides a method for designing coupling structures in which the instantaneous current as a result of an input or output signal flows in opposite directions at the same time and with a different magnitude such that the couplings due to the magnetic fields generated partially cancel each other. FIG. 8 shows a coupling structure 730 according to a yet further embodiment in which this principle is followed.

The coupling structure 730 comprises a single input/output coupling path 731 which is substantially straight and extends in the Y direction. The coupling path 731 has a length from the edge of the window 116 to its open-circuit end which is equal to three-quarters of the operating wavelength of the resonator body 110. Thus, when the input or output signal is applied to the coupling path, resonance will occur in the following manner: at the point of connection with the (grounded) conductive layer 114, there is a current anti-node (i.e. current is at a maximum); at the open-circuit end there is a current node (i.e. no current flows); and at a point a third of the coupling path length from the edge of the window 116, there is another current node. The coupling path 731 therefore effectively comprises two portions: a first, quarter wavelength portion 731.1 extending from the edge of the window 116 to a point one third of the coupling path length from the edge of the window 116; and a second, half-wavelength portion 731.2 extending from the first portion 731.1 to the open-circuit end of the coupling path. At any one time, the currents in the first and second portions are travelling in opposite directions and have different magnitudes. They therefore generate magnetic fields which rotate in opposite directions and which differ in magnitude, such that partial cancellation occurs, as described above. This gives control over the degree of coupling to a particular mode of the resonator body 110 (in this case, the Y mode).

Figure 9:
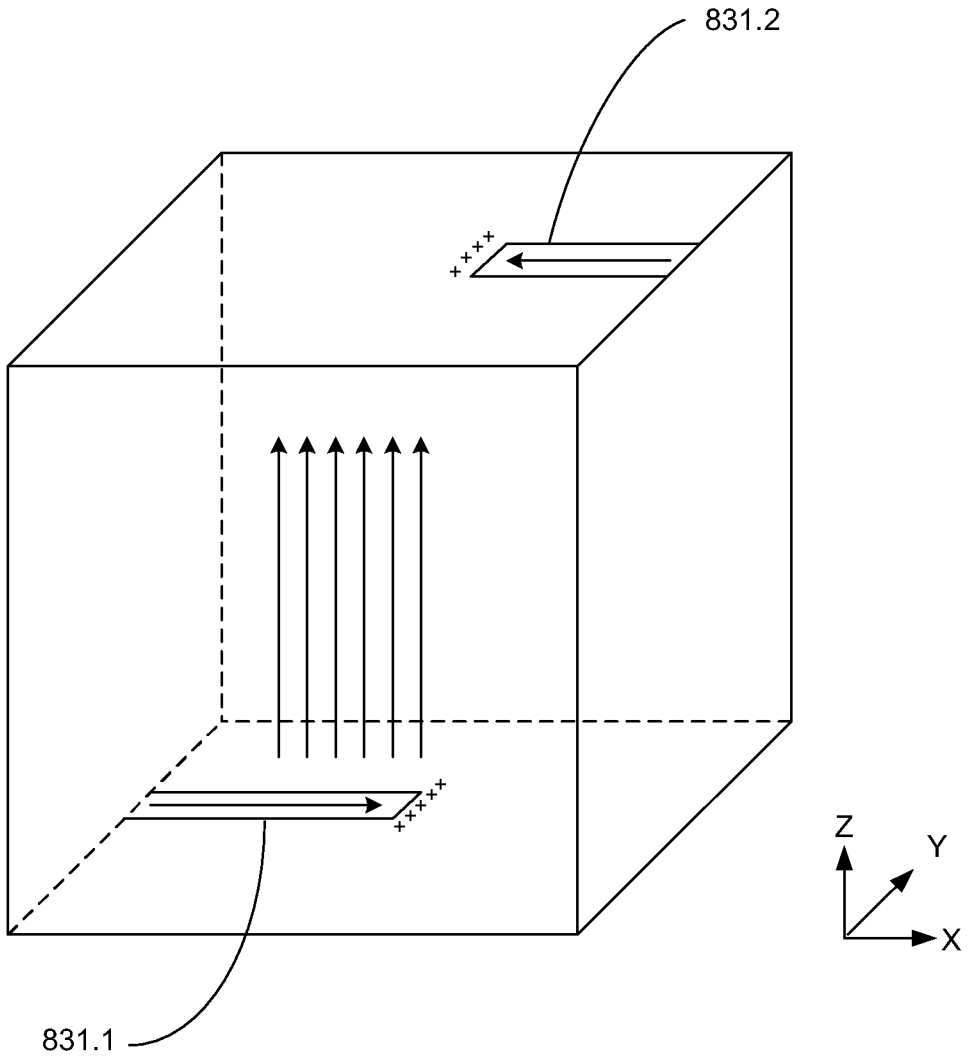

In all of the examples given above, the input or output coupling path has been on a single face of the resonator body 110. However, this need not necessarily be the case. FIG. 9 shows a coupling structure in which a coupling path (that is, one or more coupling portions connected to a common input or output) is arranged over more than one face.

In the example shown, the coupling structure comprises a single input/output coupling path 831, albeit split into two separate portions: a strong-coupling portion 831.1 extending in the X direction on a first face of the resonator body 110; and a weak-coupling portion 831.2 extending parallel to the X direction (but in the opposite direction to the strong-coupling portion 831.1) on a second face of the resonator body 110, opposite the first face. The strong-coupling portion 831.1 is longer than the weak-coupling portion 831.2 and resonant at the wavelength of the input/output signal applied to it. The weak-coupling portion 831.2 is non-resonant at that wavelength. If the strong-coupling portion 831.1 is positioned within the window 116 described and shown in the preceding Figures, the weak-coupling portion 831.2 is positioned within a corresponding window (not illustrated) in the second face. Both portions 831.1, 831.2 are coupled to a common input or output and therefore respond to the same input or output signals.

The current flowing in the strong-coupling portion 831.1 generates a magnetic field which couples to the X mode of the resonator body 110, and the current antinode at its open-circuit end produces a maximum E field which extends in all directions and couples primarily to the Z mode. The current flowing in the weak-coupling portion 831.2 generates a magnetic field in the opposite direction to that of the strong-coupling portion 831.1 and, because of its shorter, non-resonant length, has a lower magnitude. The couplings due to the magnetic fields therefore partially cancel each other and provide control over the degree of coupling to the X modes. A maximum E field is generated at the open-circuit end of the weak-coupling portion which again extends in all directions; in the resonator body 110, this E-field is in the opposite direction to the E field generated by the strong-coupling portion, and therefore couplings due to the two E fields partially cancel. This partial cancellation provides a degree of control over the degree of coupling to the Z mode.

The above description highlights one mechanism by which Z-mode control may be achieved using the partial cancellation concept outlined in this disclosure. However, there are many other possibilities. For example, it is possible to place the shorter, weak-coupling portion 831.2 directly above the longer, strong-coupling portion 831.1 and phase their respective driving signals appropriately to achieve partial Z-mode coupling cancellation. In this case, the predominant effect could be arranged to be on the Z-mode only, with limited impact on the X and Y modes.

Accordingly, the above described filter arrangements provide a simple yet effective mechanism for coupling signals to or from a resonator body, using a coupling path with first and second portions arranged such that current flows in opposite directions and the couplings due to the magnetic fields generated partially cancel one another. In this way, the degree of coupling to any particular mode of the filter can be closely controlled by varying the length and/or orientation of the portions with respect to each other.

The above described examples have focused on coupling to up to three modes. It will be appreciated this allows coupling to be to low order resonance modes of the resonator body. However, this is not essential, and additionally or alternatively coupling could be to higher order resonance modes of the resonator body.

Persons skilled in the art will appreciate that numerous variations and modifications will become apparent. All such variations and modifications which become apparent to persons skilled in the art are considered to fall within the spirit and scope of the invention broadly appearing before described.

The invention claimed is:

1. A multi-mode cavity filter, comprising:

a dielectric resonator body incorporating a piece of dielectric material, the piece of dielectric material having a shape such that it can support at least a first resonant mode and a second substantially degenerate resonant mode; and a coupling structure comprising a first coupling portion and a second coupling portion, the first coupling portion being arranged to generate a first magnetic field for coupling to at least one of the first resonant mode and the second resonant mode within the dielectric resonator body, the second coupling portion being arranged to generate a second magnetic field for coupling to at least one of the first resonant mode and the second resonant mode within the dielectric resonator body, the second magnetic field having a magnitude and a direction so as to partially cancel the coupling due to the first magnetic field, wherein the first coupling portion comprises a first conductive track arranged adjacent to a surface of the dielectric resonator body, and wherein the second coupling portion comprises a second conductive track arranged adjacent to the surface of the dielectric resonator body, and wherein the first and second conductive tracks have different lengths.

2. The multi-mode cavity filter according to claim 1, wherein an instantaneous current flow in the first coupling portion runs in an opposite direction to an instantaneous current flow in the second coupling portion.

3. A multi-mode cavity filter, comprising;

a dielectric resonator body incorporating a piece of dielectric material, the piece of dielectric material having a shape such that it can support at least a first resonant mode and a second substantially degenerate resonant mode; and a coupling structure comprising a first coupling portion and a second coupling portion, the first coupling portion being arranged to generate a first magnetic field for coupling to at least one of the first resonant mode and the second resonant mode within the dielectric resonator body, the second coupling portion being arranged to generate a second magnetic field for coupling to at least one of the first resonant mode and the second resonant mode within the dielectric resonator body, the second magnetic field having a magnitude and a direction so as to partially cancel the coupling due to the first magnetic field, wherein the first coupling portion comprises a first conductive track arranged adjacent to a surface of the dielectric resonator body, and wherein the second coupling portion comprises a second conductive track arranged adjacent to the surface of the dielectric resonator body, and wherein the first and second conductive tracks have different widths.

4. The multi-mode cavity filter according to claim 3, wherein an instantaneous current flow in the first coupling portion runs in an opposite direction to an instantaneous current flow in the second coupling portion.

5. The multi-mode cavity filter according to claim 3, wherein the first and second conductive tracks comprise different portions of the same conductive track.

6. The multi-mode cavity filter according to claim 3, wherein the first and second conductive tracks extend in opposite directions.

7. The multi-mode cavity filter according to claim 3, wherein the resonator body is substantially covered in a conductive layer, the conductive layer comprising at least one aperture in which the coupling structure is arranged.

8. The multi-mode cavity filter according to claim 3, wherein the coupling structure comprises a conductive track which forks into at least first and second arms, the first arm comprising the first conductive track and the second arm comprising the second conductive track.

9. A multi-mode cavity filter, comprising:

a dielectric resonator body incorporating a piece of dielectric material, the piece of dielectric material having a shape such that it can support at least a first resonant mode and a second substantially degenerate resonant mode; and a coupling structure comprising a first coupling portion and a second coupling portion, the first coupling portion being arranged to generate a first magnetic field for coupling to at least one of the first resonant mode and the second resonant mode within the dielectric resonator body, the second coupling portion being arranged to generate a second magnetic field for coupling to at least one of the first resonant mode and the second resonant mode within the dielectric resonator body, the second magnetic field having a magnitude and a direction so as to partially cancel the coupling due to the first magnetic field, wherein the resonator body is substantially covered in a conductive layer, the conductive layer comprising at least one aperture in which the coupling structure is arranged, wherein the first coupling portion comprises a first conductive track arranged adjacent to a surface of the dielectric resonator body, and wherein the second coupling portion comprises a second conductive track arranged adjacent to the surface of the dielectric resonator body, and wherein the first and second conductive tracks have respective first and second open-circuit ends, wherein the first open-circuit end is positioned a first distance from an edge of the aperture, and wherein the second open-circuit end is positioned a second, different distance from an edge of the aperture.

10. The multi-mode cavity filter according to claim 9, wherein an instantaneous current flow in the first coupling portion runs in an opposite direction to an instantaneous current flow in the second coupling portion.

11. The multi-mode cavity filter according to claim 9, wherein the first and second conductive tracks comprise different portions of the same conductive track.

12. The multi-mode cavity filter according to claim 9, wherein the first and second conductive tracks extend in opposite directions.

13. The multi-mode cavity filter according to claim 9, wherein the coupling structure comprises a conductive track which forks into at least first and second arms, the first arm comprising the first conductive track and the second arm comprising the second conductive track.

14. A multi-mode cavity filter, comprising:

a dielectric resonator body incorporating a piece of dielectric material, the piece of dielectric material having a shape such that it can support at least a first resonant mode and a second substantially degenerate resonant mode; and a coupling structure comprising a first coupling portion and a second coupling portion, the first coupling portion being arranged to generate a first magnetic field for coupling to at least one of the first resonant mode and the second resonant mode within the dielectric resonator body, the second coupling portion being arranged to generate a second magnetic field for coupling to at least one of the first resonant mode and the second resonant mode within the dielectric resonator body, the second magnetic field having a magnitude and a direction so as to partially cancel the coupling due to the first magnetic field, wherein the dielectric resonator body comprises at least one flat face in which the coupling structure is arranged, and wherein the first coupling portion is closer to a center of the face than the second coupling portion.

15. The multi-mode cavity filter according to claim 14, wherein an instantaneous current flow in the first coupling portion runs in an opposite direction to an instantaneous current flow in the second coupling portion.

16. The multi-mode cavity filter according to claim 14, wherein the first coupling portion comprises a first conductive track arranged adjacent to a surface of the dielectric resonator body, and wherein the second coupling portion comprises a second conductive track arranged adjacent to the surface of the dielectric resonator body.

17. The multi-mode cavity filter according to claim 16, wherein the first and second conductive tracks extend in opposite directions.

18. The multi-mode cavity filter according to claim 16, wherein the coupling structure comprises a conductive track which forks into at least first and second arms, the first arm comprising the first conductive track and the second arm comprising the second conductive track.

19. A multi-mode cavity filter, comprising:

a dielectric resonator body incorporating a piece of dielectric material, the piece of dielectric material having a shape such that it can support at least a first resonant mode and a second substantially degenerate resonant mode; and a coupling structure comprising a first coupling portion and a second coupling portion, the first coupling portion being arranged to generate a first magnetic field for coupling to at least one of the first resonant mode and the second resonant mode within the dielectric resonator body, the second coupling portion being arranged to generate a second magnetic field for coupling to at least one of the first resonant mode and the second resonant mode within the dielectric resonator body, the second magnetic field having a magnitude and a direction so as to partially cancel the coupling due to the first magnetic field, wherein the first and second magnetic fields are for coupling primarily to the first resonant mode within the dielectric resonator body, and wherein the coupling structure further comprises a third coupling portion and a fourth coupling portion, the third coupling portion being arranged to generate a third magnetic field for coupling primarily to the second resonant mode within the dielectric resonator body, the fourth coupling portion being arranged to generate a fourth magnetic field for coupling primarily to the second resonant mode within the dielectric resonator body, the fourth magnetic field having a magnitude and a direction so as to partially cancel the coupling due to the third magnetic field.

20. The multi-mode cavity filter according to claim 19, wherein the first coupling portion comprises a first conductive track arranged adjacent to a surface of the dielectric resonator body, and wherein the second coupling portion comprises a second conductive track arranged adjacent to the surface of the dielectric resonator body.

21. The multi-mode cavity filter according to claim 20, wherein the first and second conductive tracks comprise different portions of the same conductive track.

22. The multi-mode cavity filter according to claim 20, wherein the first and second conductive tracks extend in opposite directions.

23. The multi-mode cavity filter according to claim 20, wherein the coupling structure comprises a conductive track which forks into at least first and second arms, the first arm comprising the first conductive track and the second arm comprising the second conductive track.

24. The multi-mode cavity filter according to claim 20, wherein the first and second conductive tracks are arranged in series with each other.

25. The multi-mode cavity filter according to claim 19, wherein the resonator body is substantially covered in a conductive layer, the conductive layer comprising at least one aperture in which the coupling structure is arranged.

* * * * *